US007540126B2

(12) United States Patent
Abbott et al.

(10) Patent No.: US 7,540,126 B2
(45) Date of Patent: Jun. 2, 2009

(54) SYSTEM AND METHOD FOR COMPACTLY PACKAGING APPAREL

(75) Inventors: Michael D. Abbott, Statesville, NC (US); Joseph M. Brucato, Winston-Salem, NC (US); Gregory V. Stagnitta, Nazareth, PA (US); Tom Wood, Mooresville, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 394 days.

(21) Appl. No.: 11/406,589

(22) Filed: Apr. 19, 2006

(65) Prior Publication Data

US 2007/0245692 A1 Oct. 25, 2007

(51) Int. Cl.
*B65B 63/02* (2006.01)

(52) U.S. Cl. ..... 53/438; 53/529

(58) Field of Classification Search ..... 53/436, 53/438, 523, 527, 528, 529; 229/87.15, 87.17
See application file for complete search history.

(56) References Cited

U.S. PATENT DOCUMENTS

| | | | | | |
|---|---|---|---|---|---|
| 2,425,301 | A | * | 8/1947 | Browner | 206/83.5 |
| 2,659,935 | A | * | 11/1953 | Hammon | 264/321 |
| 3,099,952 | A | * | 8/1963 | Olaf et al. | 100/3 |
| 3,405,744 | A | * | 10/1968 | Bowman | 141/12 |
| 3,585,925 | A | * | 6/1971 | Fox | 100/218 |
| 3,868,809 | A | * | 3/1975 | Bledsoe | 53/117 |
| 3,958,392 | A | | 5/1976 | Beninger | 53/24 |
| 4,163,353 | A | | 8/1979 | Finn et al. | 53/430 |
| 4,235,063 | A | | 11/1980 | Paetz | 53/436 |
| 4,240,193 | A | | 12/1980 | Krein | 29/451 |
| 4,272,874 | A | | 6/1981 | Krein | 29/235 |
| 4,318,264 | A | | 3/1982 | Rewitzer | 53/436 |
| 4,372,101 | A | | 2/1983 | Fleissner | 53/435 |
| 4,411,122 | A | | 10/1983 | Cornish et al. | 53/436 |
| 4,414,788 | A | | 11/1983 | Berg | 53/436 |
| 4,432,188 | A | | 2/1984 | Andrews | 53/436 |
| RE31,944 | E | | 7/1985 | Stromberg | 53/438 |
| 4,595,093 | A | | 6/1986 | Eckstein | 206/44 R |
| 4,660,352 | A | | 4/1987 | Deines et al. | 53/438 |
| 4,688,369 | A | | 8/1987 | Cornish et al. | 53/436 |
| 4,706,440 | A | | 11/1987 | Bittner | 53/438 |
| 4,815,253 | A | | 3/1989 | Kovacs et al. | 53/436 |
| 4,821,491 | A | | 4/1989 | Rias | 53/438 |
| 4,848,222 | A | * | 7/1989 | Fleissner | 100/35 |
| 4,924,656 | A | | 5/1990 | Kovacs et al. | 53/436 |
| 5,012,732 | A | * | 5/1991 | Fox | 100/35 |
| 5,022,216 | A | | 6/1991 | Muckenfuhs et al. | 53/438 |
| 5,042,227 | A | | 8/1991 | Merry | 53/438 |

(Continued)

FOREIGN PATENT DOCUMENTS

| | | |
|---|---|---|
| DE | 29610959 | 10/1996 |

(Continued)

*Primary Examiner*—Paul R Durand
(74) *Attorney, Agent, or Firm*—Womble Carlyle Sandridge & Rice PLLC

(57) ABSTRACT

A method is provided for compacting textile articles for packaging. At least one article is placed in a mold. The article is compressed multiple times to form a rigid bundle, each compression including the steps of subjecting the article to a predetermined pressure for a predetermined period. Between each compression, the pressure is released. Each compression reduces the compacted volume of the rigid bundle.

26 Claims, 7 Drawing Sheets

U.S. PATENT DOCUMENTS

| | | | | | |
|---|---|---|---|---|---|
| 5,125,210 | A | * | 6/1992 | Lang et al. | 53/399 |
| 5,131,210 | A | | 7/1992 | Kiya | 53/339 |
| 5,136,825 | A | | 8/1992 | White, Jr. | 53/429 |
| 5,150,561 | A | | 9/1992 | Muckenfuhs | 53/412 |
| 5,172,629 | A | * | 12/1992 | Merry | 100/35 |
| 5,177,938 | A | | 1/1993 | Mayersbeth | 53/502 |
| 5,224,324 | A | | 7/1993 | Granfelt | 53/436 |
| 5,309,828 | A | | 5/1994 | Merry | 100/35 |
| 5,406,774 | A | | 4/1995 | Dodge | 53/436 |
| 5,417,912 | A | * | 5/1995 | Merry | 264/320 |
| 5,437,144 | A | | 8/1995 | Akiyama et al. | 53/466 |
| 5,447,012 | A | | 9/1995 | Kovacs et al. | 53/433 |
| 5,517,908 | A | * | 5/1996 | Stout | 100/90 |
| 5,524,531 | A | | 6/1996 | Merry | 100/35 |
| 5,603,284 | A | | 2/1997 | Freedman | 119/28.5 |
| 5,622,030 | A | | 4/1997 | Steed et al. | 53/436 |
| 5,692,606 | A | | 12/1997 | Elmaleh | 206/278 |
| 5,735,106 | A | | 4/1998 | Burda et al. | 53/413 |
| 5,788,130 | A | * | 8/1998 | Todd et al. | 223/37 |
| 5,800,766 | A | * | 9/1998 | Merry | 264/324 |
| 5,813,538 | A | | 9/1998 | Kaufman | 206/457 |
| 5,816,142 | A | | 10/1998 | Keller et al. | 100/35 |
| 5,832,696 | A | | 11/1998 | Nagy et al. | 53/430 |
| 5,870,885 | A | | 2/1999 | Biddle et al. | 53/436 |
| RE36,142 | E | | 3/1999 | Steed et al. | 53/436 |
| 5,878,551 | A | | 3/1999 | Curley et al. | 53/434 |
| 5,930,983 | A | | 8/1999 | Terminella et al. | 53/436 |
| 5,943,846 | A | * | 8/1999 | Pollock | 53/529 |
| 5,971,153 | A | | 10/1999 | Bauer et al. | 206/494 |
| 5,979,145 | A | | 11/1999 | Louis et al. | 53/439 |
| 5,987,858 | A | * | 11/1999 | Long | 53/529 |
| 5,996,320 | A | | 12/1999 | Todd et al. | 53/526 |
| 6,021,626 | A | | 2/2000 | Goodman | 53/438 |
| 6,085,486 | A | * | 7/2000 | Hunter et al. | 53/176 |
| 6,155,028 | A | | 12/2000 | Nagata et al. | 53/436 |
| 6,321,511 | B1 | | 11/2001 | O'Connor et al. | 53/429 |
| 6,357,210 | B1 | | 3/2002 | Wetter | 53/436 |
| 6,381,925 | B2 | | 5/2002 | Rejcek et al. | 53/436 |
| 6,622,857 | B2 | | 9/2003 | Ohtsubo et al. | 206/287 |
| 6,637,177 | B1 | | 10/2003 | Trillich et al. | 53/434 |
| 6,668,522 | B2 | | 12/2003 | Prakken | 53/437 |
| 6,687,918 | B1 | | 2/2004 | Hooks et al. | 2/275 |
| 6,711,881 | B1 | * | 3/2004 | McCracken et al. | 53/529 |

FOREIGN PATENT DOCUMENTS

| | | |
|---|---|---|
| DE | 29615241 | 11/1996 |
| DE | 29716438 | 12/1997 |
| LU | 33062 | 8/1954 |

* cited by examiner

Knitted, 100% Cotton T-Shirts (Stack of 3)

| PRESSURE (PSI) | TOTAL COMPRESSION TIME IN SECONDS (TSEC) | % TOTAL VOLUME REDUCTION ONE COMPRESSION (1 x TSEC) | % TOTAL VOLUME REDUCTION TWO COMPRESSIONS (2 x Tsec/2) |
|---|---|---|---|
| 2,700 | 2 | 28.1 | 30.1 |
| | 4 | 30.1 | 31.5 |
| | 6 | 30.6 | 30.1 |
| 2,900 | 2 | 31.7 | 31.8 |
| | 4 | 33.6 | 34.2 |
| | 6 | 33.6 | 34.3 |
| 3,100 | 2 | 35.1 | 35.5 |
| | 4 | 37.6 | 39.0 |
| | 6 | 38.0 | 40.2 |
| 3,300 | 2 | 39.1 | 41.2 |
| | 4 | 41.8 | 43.8 |
| | 6 | 42.2 | 43.8 |

*FIG. 6*

SYSTEM AND METHOD FOR COMPACTLY PACKAGING APPAREL

FIELD OF THE INVENTION

The present invention relates generally to packaging of textile products for retail sale and, more particularly, to a system and method for compactly packaging and merchandising items of apparel.

BRIEF DESCRIPTION OF THE DRAWINGS

FIG. 6 is a table of exemplary test data;

DETAILED DESCRIPTION OF THE PREFERRED EMBODIMENTS

Certain exemplary embodiments of the present invention are described below and illustrated in the attached Figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

The present invention is directed to a method for compacting articles of apparel in preparation for subsequent packaging. More specifically, the method produces a rigid bundle of compacted articles that has a compacted, packaged volume that is unexpectedly substantially less than that produced by compaction methods known in the prior art.

One aspect of the present invention is directed to the method of compacting articles of apparel for subsequent packaging. As will be described in greater detail below, various methods may be employed for constructing and forming the compacted, or compressed, rigid bundle. As used herein, the terms "compact" and "compress", and variations thereof, are used interchangeably to refer to the application of pressure to one or more articles. Also as used herein, "rigid" bundle refers to a compacted bundle of articles that substantially retains its compacted shape when removed from the compacting apparatus.

Figure 1:
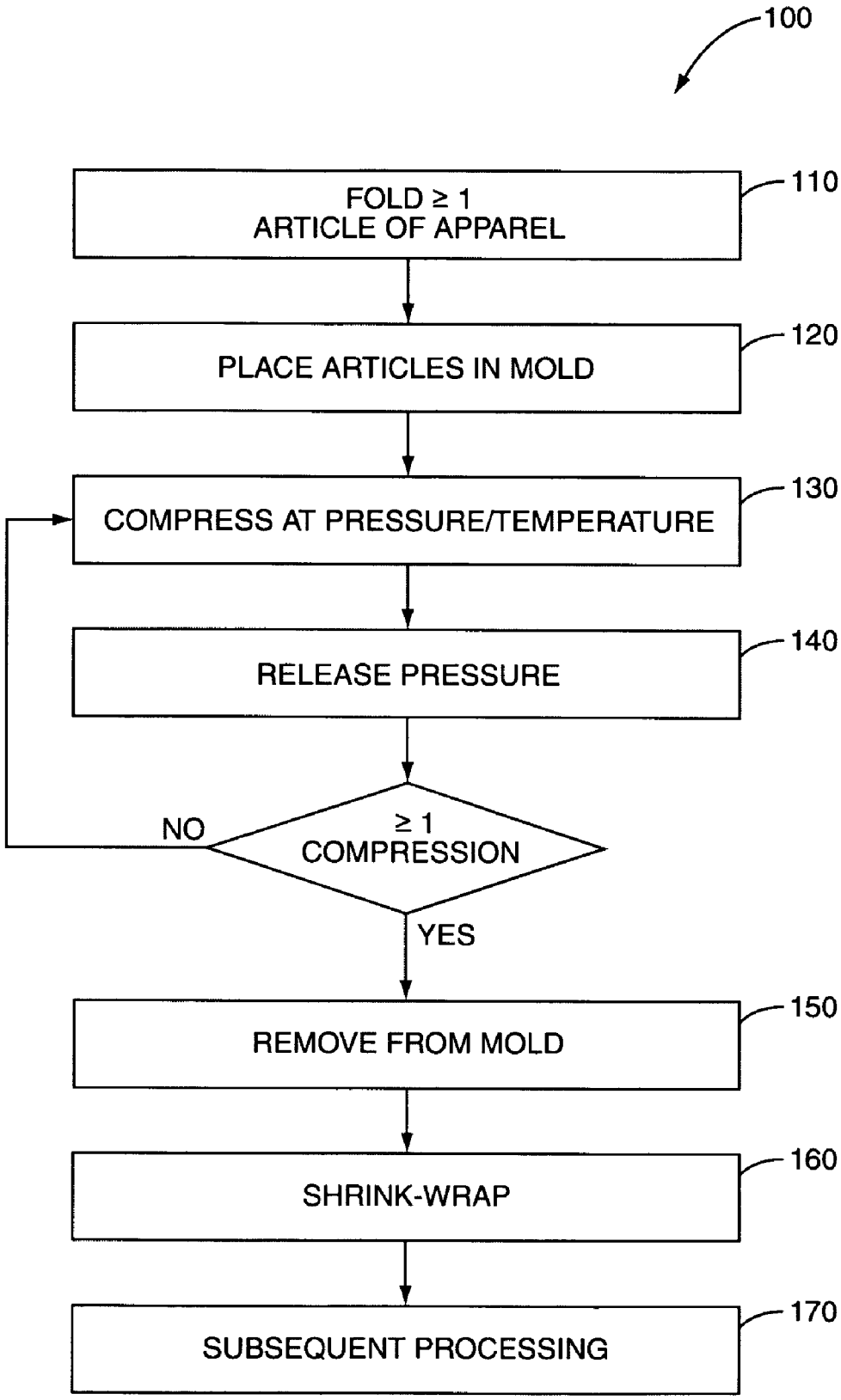
FIG. 1 is a flow diagram of the compaction method of the present invention.
Figure 2:
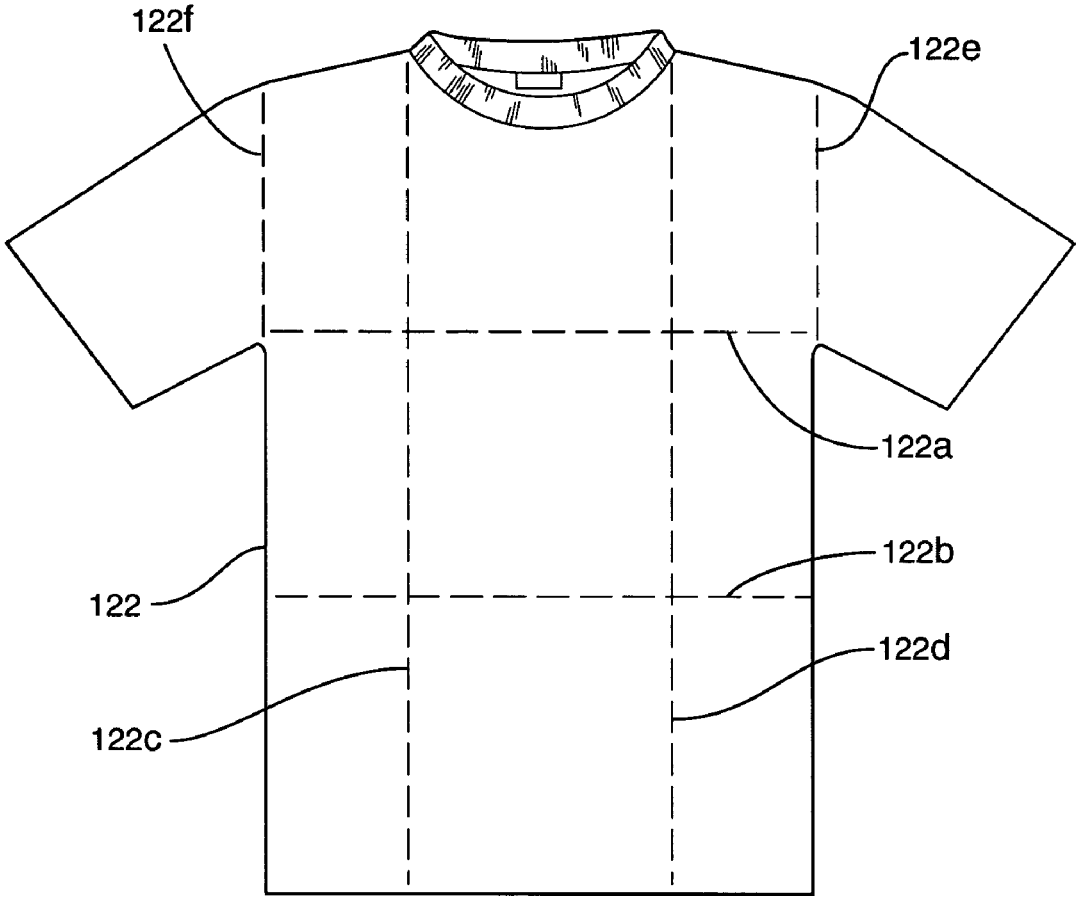
FIG. 2 is a front view illustrating an exemplary folding scheme for a T-shirt.
Figure 3:
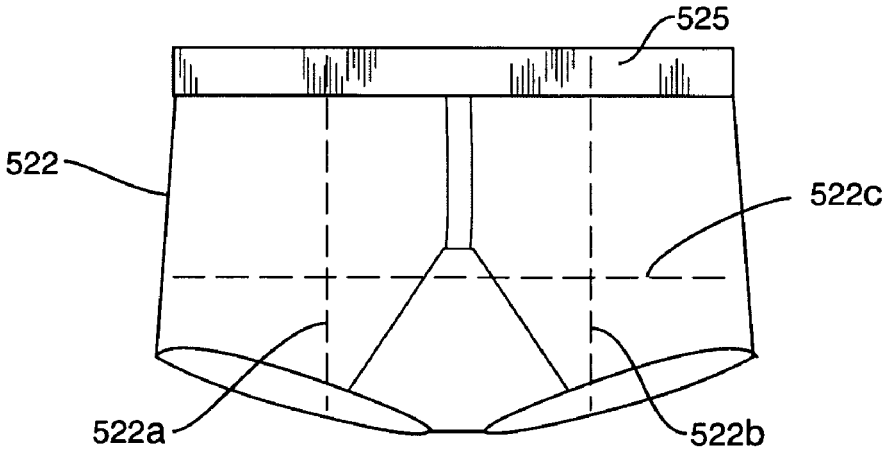
FIG. 3 is a front view illustrating an exemplary folding scheme for a pair of briefs.

Referring first to FIGS. 1-3, the method 100 of the present invention is graphically illustrated. While not required, the articles of apparel may be first folded (Step 110) and placed in a stack before being compressed. As shown in FIG. 2, an article of apparel such as a T-shirt 122 may first be folded to a desired shaped that will conform to the shape of the mold used to compress the bundle. As shown, the T-shirts 122 may first be folded about fold lines 122*c* 122*d*, and subsequently folded about fold lines 122*a* and 122*b*. The sleeve portions may also be folded inward along fold lines 122*e* and 122*f*. Alternatively, the T-shirts 122 may first be folded about fold lines 122*a* and 122*b*, and subsequently folded about fold lines 122*c* and 122*d*. The sleeve portions may also be folded inward along fold lines 122*e* and 122*f*. Referring to FIG. 3, briefs 522 may be similarly folded about fold lines 522*a*, 522*b*, and 522*c* where a generally rectangular or square shape is desired.

While the exemplary embodiments shown herein are T-shirts and briefs (underwear), the present invention is not limited thereto; rather, the articles may be any form of apparel that is adaptable to compaction. While knitted articles have been found to be particularly suitable for compaction into rigid bundles, woven and non-woven articles may also be compressed and packaged in accordance with the method described herein. By way of example, where the articles are underwear (briefs or panties) or T-shirts, the rigid bundle will desirably comprise 3 or more similar articles. On the other hand, for larger items such as a bulky terry bathrobe, a single bathrobe or other bulky article is compressed as described herein.

Turning now to FIGS. 4 and 5, one or more articles of apparel are first placed in a mold (Step 120) having a desired shape. The one or more articles of apparel are then compacted/compressed (Step 130) by subjecting them to at least two compression steps, as described in greater detail below, wherein each compression step comprises the application of a predetermined pressure for a predetermined period of time to form a substantially rigid bundle 200 that substantially retains the shape of the mold. The hydraulic pressure is released (Step 140) between each compression. The rigid bundle is then removed from the mold (Step 150).

Although not required, in one embodiment the rigid bundle is shrink-wrapped (Step 160) to maintain the compressed shape of the rigid bundle during subsequent handling, packaging, and retail display. The shrink-wrapped articles may be marked, labeled, etc. in preparation for warehousing or shipment for retail sale (Step 170).

Alternatively, after shrink-wrapping, at least one un-compacted similar article may be positioned relative to the compacted bundle so that the un-compacted article of apparel is visible to the consumer when packaged and displayed in a retail setting. Lastly, the compacted bundle and the un-compacted article may be packaged in another suitable material such as shrink-wrap or a poly-bag to form a single display package. Again, the single display package may be marked, labeled, etc.

Figure 4A:
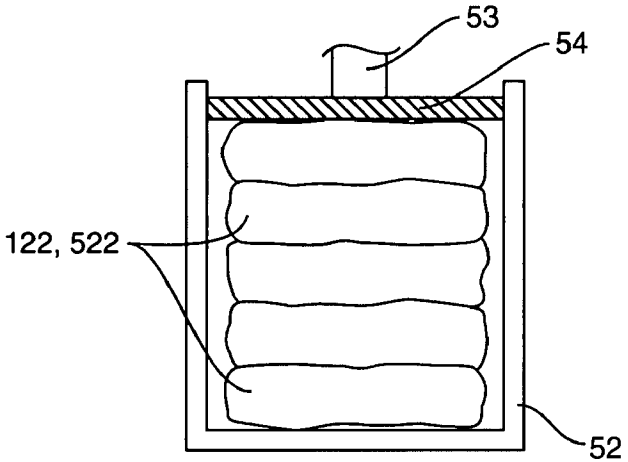
FIG. 4A is a cut-away side view of a mold cavity showing stacked apparel before being compacted.
Figure 4B:
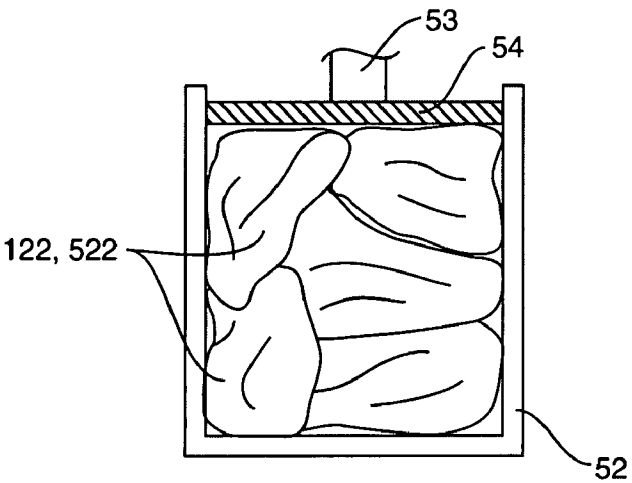
FIG. 4B is a cut-away side view of a mold cavity showing loosely packed apparel before being compacted.

As shown in FIG. 4A, folded articles such as T-shirts 122, or underwear 522, are placed in the mold 52 having a desired shape. While the invention is not limited to a specific shape, a mold 52 cavity having a generally rectangular or square shape may be used for the compression of the apparel. The folded articles 122, 522 of apparel in this example have previously been folded to a size that already generally conforms to the cross-sectional size of the mold 52 cavity. Alternatively, as shown in FIG. 4B, unfolded articles may be loosely placed in the mold 52 cavity when the outer aesthetic appearance of the compacted rigid bundle is not important, so long as the desired compressed bundle is achieved from the compaction process described herein. Also, because the apparel must be laundered before it is worn, the apparel may be compacted without first being folded.

Once the desired number of articles 122, 522 have been placed in the mold in a stacked arrangement, the piston 53, or cylinder, of the compression apparatus is actuated to compress the articles into a compacted bundle. A hydraulically-powered press is used to operate the piston 53, the piston 53 being fitted with a shaped plunger 54 that delivers the compacting, or compressing, force to apparel placed in a mold 52 cavity. The plunger 54 conforms generally in cross-section to the cross-section of the mold 52 cavity. One suitable press is the Model C-20 Plus hydraulic press, manufactured by Conway Press of Columbia, S.C. This press is a 20-ton press having a 4 inch cylinder with an attached plunger of a desired area for the articles being compacted. Other presses or compression devices, however, which are capable of delivering the required pressures described herein may be employed for this method.

Figure 5A:
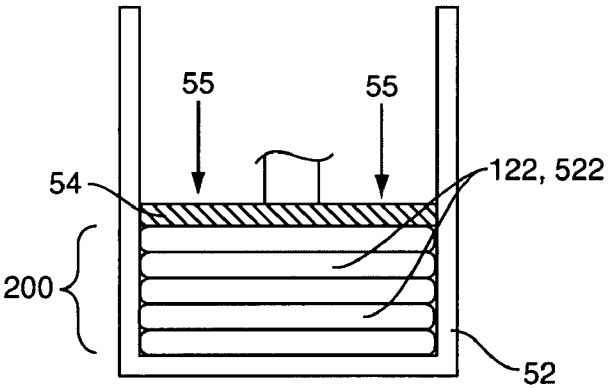
FIG. 5A is a cut-away side view of the mold cavity of FIG. 4A showing the compacted apparel.
Figure 5B:
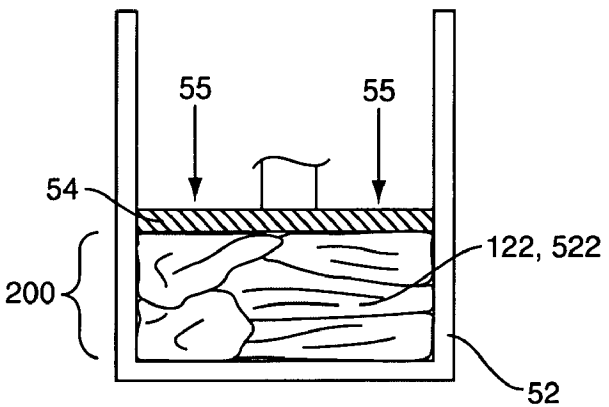
FIG. 5B is a cut-away side view of the mold cavity of FIG. 4B showing the compacted apparel.

The application of relatively high pressures achieves the desired compaction of multiple articles of apparel, without damaging the apparel. FIGS. 5A and 5B are exemplary of the mechanical compaction process whereby the piston 53 moves downwardly (illustrated by arrows 55), or the mold moves upwardly, to compact via the plunger 54 the stacked apparel of FIGS. 4A and 4B, respectively.

More specifically, with the hydraulic press selected for this process, and as described above, one embodiment of the method comprises two compressions, where each compression is performed for a predetermined time and at a predetermined pressure of at least about 2,700 pounds per square inch, and preferably between about 3,300 pounds per square inch and 3,400 pounds per square inch. The inventors have found that pressures as high as about 4,000 pounds per square inch can be applied without damaging the fabric of the articles.

The table of FIG. 6 provides exemplary test data at compression pressures between about 2,700 pounds per square inch and 3,300 pounds per square inch on manually-folded stacks of apparel, each stack comprising three knitted 100 percent cotton T-shirts. Similar results would be expected on stacks of other articles of apparel such as knitted underwear, hosiery, etc. A new uncompressed stack of T-shirts was compressed and measured to obtain each volume reduction data entry in FIG. 6; e.g., at 3,300 pounds per square inch and at a compression duration of 1.0 second, two similar uncompressed stacks were tested one at a time to obtain data for each of the two compressions. That is, a first uncompressed stack was compressed once for 1.0 second to obtain a volume reduction of 36.2 percent. A second uncompressed stack was compressed twice for 1.0 seconds to obtain a volume reduction of 41.2 percent, etc. New uncompressed stacks were used for each data point because of the inaccuracies that would result from removing from the mold, and potentially altering, a compressed stack after each compression for measurement. Thus, this accounts for insubstantial variations in the data that are attributable to minor differences in the folding and stacking of the articles, manual placement in the mold during testing, etc.

In the exemplary embodiments illustrated in FIG. 6, each compression is held at the predetermined pressure for between about 1.0 second and 3 seconds, although compression times of as low as 0.5 seconds have been found to provide suitable compression. The pressure is then released for a period sufficient for the hydraulic cylinder to withdraw (less than 1 second), and the compression step is repeated at the same pressure for a similar prescribed duration. In general, multiple compressions at similar pressures will produce incremental volume reductions that are cumulatively greater than the volume reduction achieved with a single compression at the same pressure for the same cumulative duration. For example, the application of a pressure of about 3,300 pounds per square inch for 3 seconds in each of two sequential compressions results in a greater volume reduction (43.8 percent) of the stack of apparel than the volume reduction (42.2 percent) from a single compression of 3,300 pounds per square inch applied for 6 seconds.

Figure 7:
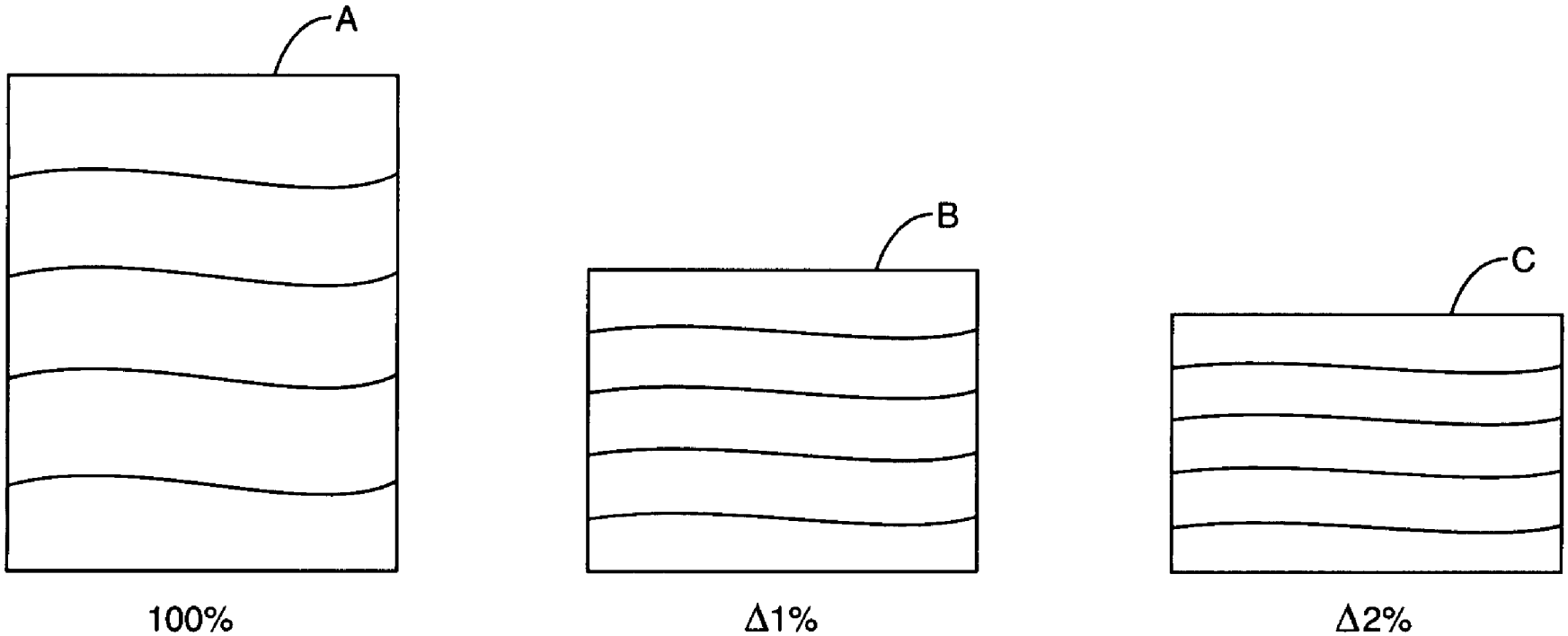
FIG. 7 is a schematic illustrating the relative volume reduction obtained by method of the present invention.

Referring now to FIG. 7, the relative volumetric results are illustrated for one embodiment of the compaction process, with a selected compression pressure of about 3,300 pounds per square inch, and two three-second compressions. Stack A is representative of a folded stack of apparel items before any compaction. Specifically, the representative bundle is comprised of T-shirts formed of 100 percent cotton. This represents a stack having a relative initial volume of 100 percent. Following the first compression, when performed as described above, the compacted stack B has a volume that is at least about 40 percent (41 percent) less ($\Delta 1$) than the original un-compacted Stack A. The second of the plurality of compressions further reduces the volume of the stack by about another 3 percent. Thus, Stack C then has a rigid compressed volume that is about 44 percent (43.8 percent) less ($\Delta 2$) than the uncompacted stack A. The actual volume reduction is of course dependent upon the type, material, and number of items of apparel in the beginning stack A. Additional compressions will yield some additional volume reduction, as shown in FIG. 6; however, as those skilled in the art will appreciate, additional compressions beyond the first several compressions will yield only marginal further reductions in volume. For example, where the stacks are subjected to 5 total compressions, the additional volume reduction for compressions three through five range between 1.1 percent and 3.5 percent.

In virtually all embodiments, because of the application of such relatively high pressures, the apparel comprising the bundle 200 must be laundered before wearing the apparel to return it to its original un-compacted condition to substantially remove any creases and wrinkles imparted by the compaction process.

Figure 8A:
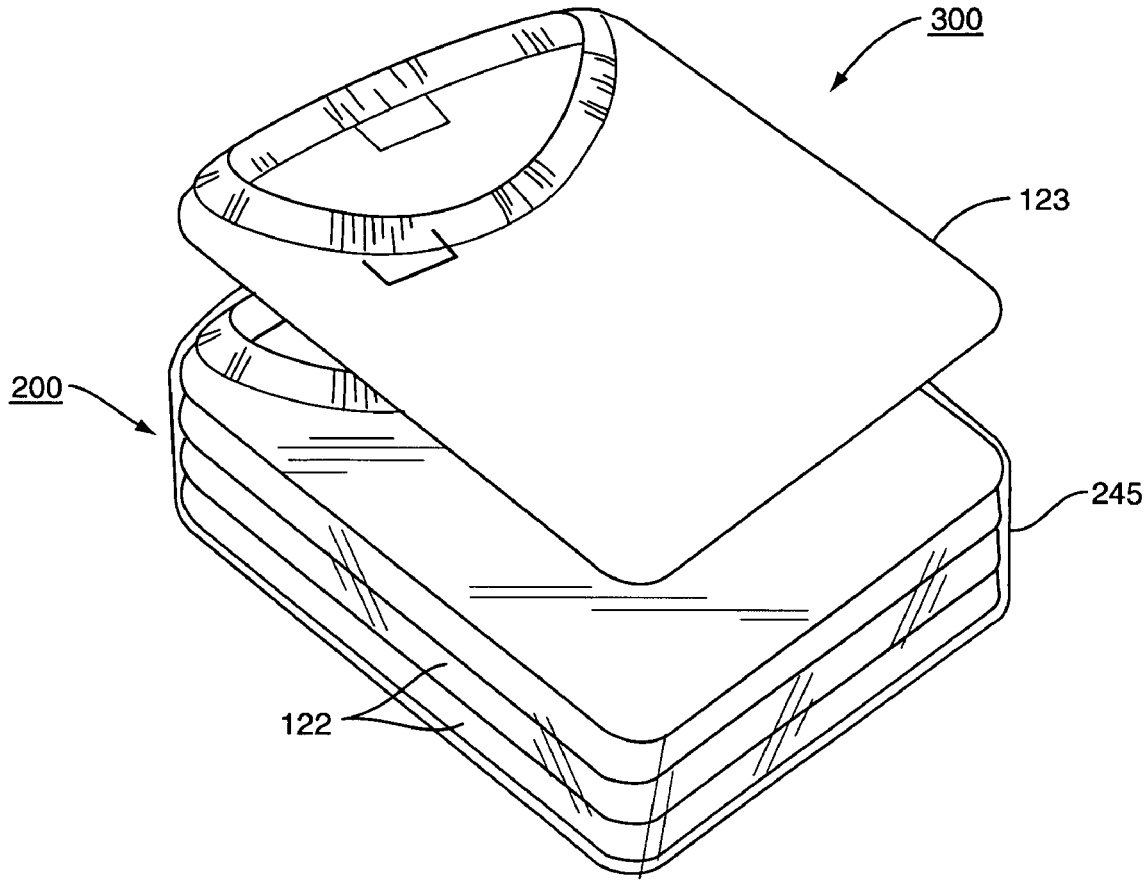
FIG. 8A is an exploded view of an alternative embodiment of a display package illustrating the placement of an un-compressed article of apparel, such as a T-shirt, relative to a compressed, shrink-wrapped, rigid bundle of articles formed in accordance with the present invention.
Figure 8B:
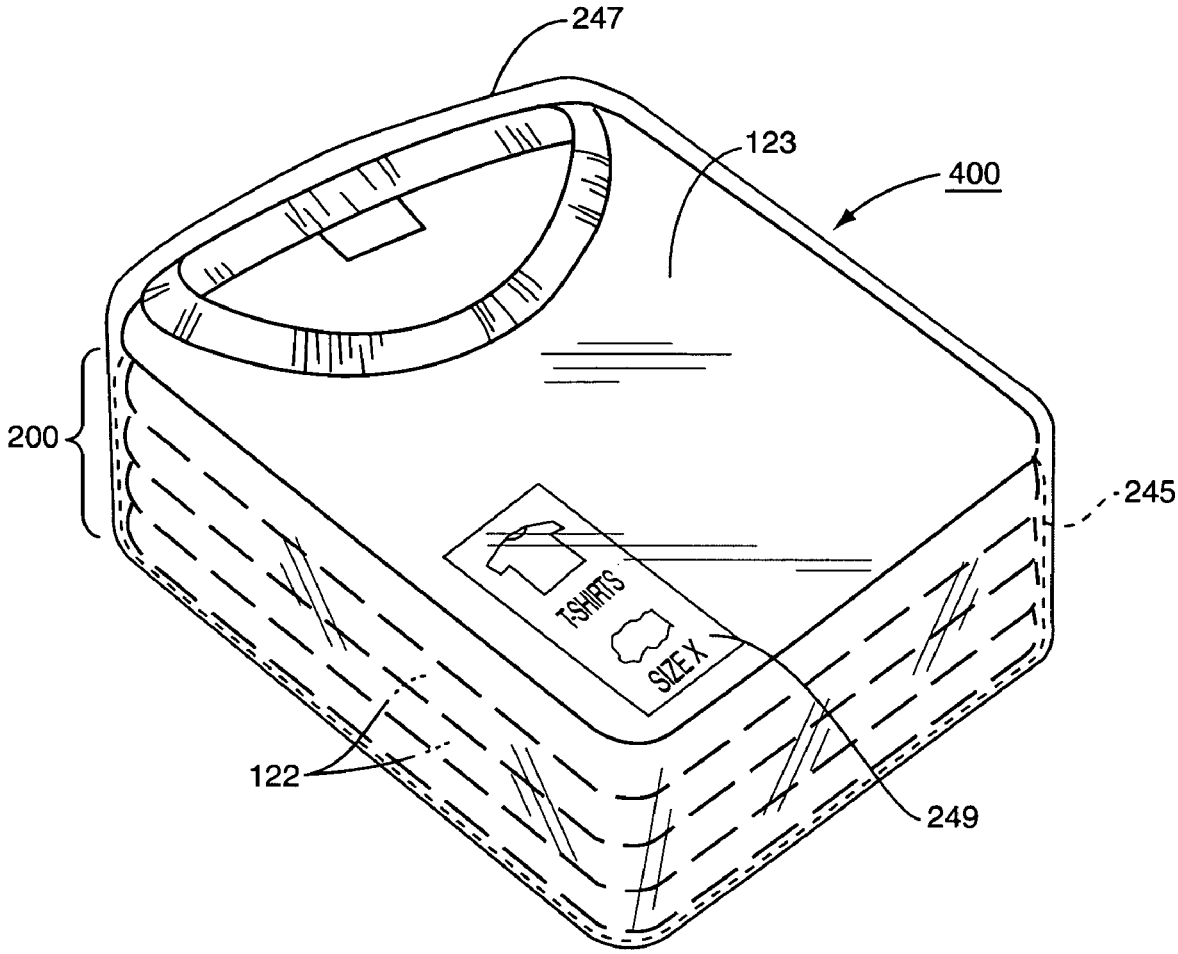
FIG. 8B is a top perspective view of a of the completed display package comprising both a compressed, shrink-wrapped rigid bundle, and an un-compressed article placed on top of the shrink-wrapped bundle.

Turning lastly to FIGS. 8A and 8B, the construction of exemplary packages 300, 400 are shown in greater detail. In the embodiment shown in FIG. 7A, the compacted bundle 200 has been formed from folded and stacked apparel 122. Once the bundle 200 has been formed, the bundle 200 is shrink-wrapped or wrapped in another suitable packaging material 245. Wrapping the compacted bundle 200 helps to prevent the inadvertent un-compacting of the apparel by a retail consumer who may happen to open the finished display package to touch or handle the un-compressed article. Alternatively, the bundle 200 may be directly packaged in a single retail display package, or bag. Although not required, at least one un-compressed article 123 of apparel, such as another T-shirt, may be folded and placed on top of the shrink-wrapped bundle 200. When so placed, the un-compressed article is predominantly visible to potential consumers. Thus, any creases and wrinkles present in the compacted bundle 200 are at least partially hidden from view when the package is displayed. As shown in FIG. 7B, where an un-compressed article is included, the shrink-wrapped bundle 200 and the un-compacted article 123 may be wrapped or packaged together in another suitable display wrap or bag 247 to complete the display package 400. Labels or other indicia 249 may be placed either beneath the wrap or bag 247 or affixed to an outer surface.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents. It should also be understood that terms used herein should be given their ordinary meaning to a person of ordinary skill in the art, unless specifically defined or limited in the application itself or in the ensuing prosecution with the Patent Office.

We claim:

1. A method for compacting textile articles for packaging, comprising:

placing at least one article in a mold, the at least one article having an un-compacted volume;

compressing the at least one article a plurality of times at a predetermined pressure for a predetermined period to form a rigid bundle having a final compacted volume, each compression comprising:

subjecting the at least one article to the predetermined pressure for the predetermined period to form a rigid bundle having a compacted volume;

releasing the pressure on the article; and removing the rigid bundle from the mold, wherein the final compacted volume is less than the compacted volume.

2. The method of claim 1 wherein the plurality of compressions is 2.

3. The method of claim 2 wherein the predetermined pressure is at least about 2,700 pounds per square inch.

4. The method of claim 3 wherein the predetermined period of time is at least about 3 seconds.

5. The method of claim 4 wherein the plurality of compressions produces a compacted volume that is at least 30 percent less than the un-compacted volume of the at least one article.

6. The method of claim 4 wherein the plurality of compressions produces a compacted volume that is between about 30 percent and about 40 percent less than the un-compacted volume of the at least one article.

7. The method of claim 1 wherein the predetermined pressure is released for between about 0.3 seconds and 1.0 second between each of the plurality of compressions.

8. The method of claim 1 further comprising a first step of folding the at least one article before placing the at least one article into the mold.

9. The method of claim 1, further comprising:

positioning an un-compacted article relative to the compressed rigid bundle so that the un-compacted article is visible when packaged; and packaging the rigid bundle and the un-compacted article in a single package.

10. The method of claim 1 further including the step of shrink-wrapping the rigid bundle.

11. The method of claim 1 further including the step of packaging the rigid bundle in a display package.

12. A compacted textile product, the compacted textile product formed by the process comprising:

placing at least one article in a mold, the at least one article having an un-compacted volume;

compressing the at least one article a plurality of times at a predetermined pressure for a predetermined period to form a rigid bundle having a final compacted volume, each compression comprising:

subjecting the at least one article to the predetermined pressure for the predetermined period to form a rigid bundle having a compacted volume;

releasing the pressure on the article; and removing the rigid bundle from the mold, wherein the final compacted volume is less than the compacted volume.

13. The compacted textile product of claim 12 wherein the plurality of compressions is 2.

14. The compacted textile product of claim 13 wherein the predetermined pressure is at least about 2,700 pounds per square inch.

15. The compacted textile product of claim 14 wherein the predetermined period of time is at least about 3 seconds.

16. The compacted textile product of claim 15 wherein the plurality of compressions produces a compacted volume that is at least 30 percent less than the un-compacted volume of the at least one article.

17. The compacted textile product of claim 15 wherein the plurality of compressions produces a compacted volume that is between about 30 percent and about 40 percent less than the un-compacted volume of the at least one article.

18. The compacted textile product of claim 12 wherein the predetermined pressure is released for between about 0.3 seconds and 1.0 second between each of the plurality of compressions.

19. The compacted textile product of claim 12 further comprising a first step of folding the at least one article before placing the at least one article into the mold.

20. The compacted textile product of claim 12, further comprising:

positioning an un-compacted article relative to the compressed rigid bundle so that the un-compacted article is visible when packaged; and packaging the rigid bundle and the un-compacted article in a single package.

21. The compacted textile product of claim 12 further including the step of shrink-wrapping the rigid bundle.

22. The compacted textile product of claim 12 further including the step of packaging the rigid bundle in a display package.

23. A method for compacting textile articles for packaging, comprising:

placing at least one article in a mold, the at least one article having an un-compacted volume;

compressing the at least one article a plurality of times to form a rigid bundle having a compacted volume, each compression comprising:

subjecting the at least one article to a predetermined pressure for a predetermined period;

releasing the predetermined pressure on the article for between about 0.3 seconds and 1.0 second between each of the plurality of compressions, wherein the compression reduces the compacted volume of the rigid bundle; and removing the rigid bundle from the mold.

24. A method for compacting textile articles for packaging, comprising:

placing at least one article in a mold, the at least one article having an un-compacted volume;

compressing the at least one article a plurality of times to form a rigid bundle having a compacted volume, each compression comprising:

subjecting the at least one article to a predetermined pressure for a predetermined period;

releasing the pressure on the article, wherein the compression reduces the compacted volume of the rigid bundle;

removing the rigid bundle from the mold;

positioning an un-compacted article relative to the rigid bundle so that the un-compacted article is visible when packaged; and packaging the rigid bundle and the un-compacted article in a single package.

25. A compacted textile product, the compacted textile product formed by the process comprising:

placing at least one article in a mold, the at least one article having an un-compacted volume;

compressing the at least one article a plurality of times to form a rigid bundle having a compacted volume, each compression comprising:

subjecting the at least one article to a predetermined pressure for a predetermined period;

releasing the predetermined pressure on the article for between about 0.3 seconds and 1.0 second between each of the plurality of compressions, wherein the compression reduces the compacted volume of the rigid bundle; and removing the rigid bundle from the mold.

26. A compacted textile product, the compacted textile product formed by the process comprising:

placing at least one article in a mold, the at least one article having an un-compacted volume;

compressing the at least one article a plurality of times to form a rigid bundle having a compacted volume, each compression comprising:

subjecting the at least one article to a predetermined pressure for a predetermined period;

releasing the pressure on the article, wherein the compression reduces the compacted volume of the rigid bundle;

removing the rigid bundle from the mold;

positioning an un-compacted article relative to the rigid bundle so that the un-compacted article is visible when packaged; and packaging the rigid bundle and the un-compacted article in a single package.

* * * * *